United States Patent [19]

Yano et al.

[11] Patent Number: 4,637,358

[45] Date of Patent: Jan. 20, 1987

[54] SPARK PLUG CAP APPARATUS

[75] Inventors: Yoshiki Yano, Saitama; Toshihiro Oikawa, Tokyo, both of Japan

[73] Assignee: Honda Giken Kogyo Kabushiki Kaisha, Tokyo, Japan

[21] Appl. No.: 781,247

[22] Filed: Sep. 27, 1985

[30] Foreign Application Priority Data

Sep. 27, 1984 [JP] Japan ..... 59-144992[U]
Sep. 27, 1984 [JP] Japan ..... 59-144991[U]

[51] Int. Cl.[4] ..... F02P 1/00
[52] U.S. Cl. ..... 123/169 PA; 123/169 PH
[58] Field of Search ..... 123/169 PA, 169 PH, 123/432, 169 R; 215/317, 325, 328, 355; 425/809, 812

[56] References Cited

U.S. PATENT DOCUMENTS

| | | | |
|---|---|---|---|
| 1,484,335 | 2/1924 | Kerrigan | 123/169 PH |
| 1,689,690 | 10/1928 | Sandin | 123/169 PH |
| 1,785,861 | 12/1930 | Flogaus | 123/169 PH |
| 1,801,023 | 4/1931 | Rohde | 123/169 PH |
| 1,979,999 | 11/1934 | Rabezzana | 123/169 PH |
| 1,993,014 | 3/1935 | Mascuch | 123/169 PH |
| 2,171,165 | 8/1939 | Rabezzana | 123/169 PA |
| 2,301,572 | 11/1942 | Nowosiclski | 123/169 PH |
| 3,697,796 | 10/1972 | Livingston | 123/169 PH |
| 4,078,696 | 3/1978 | Crisco | 215/317 |
| 4,135,635 | 1/1979 | Fujii et al. | 215/317 |
| 4,267,811 | 5/1981 | Springer | 123/432 |
| 4,354,609 | 10/1982 | Hidding | 215/318 |

*Primary Examiner*—Raymond A. Nelli
*Attorney, Agent, or Firm*—Lyon & Lyon

[57] ABSTRACT

A spark plug cap apparatus for an internal combustion engine having relatively deep and generally vertical spark plug receiving bores. The upper end of the bore is provided with an annular protrusion. A resilient head cover has a bent flange for extending over and sealably engaging the annular protrusion. The head cover has a downwardly extending seal lip for engaging the inside of the bore. A pipe is molded to the head cover and extends downwardly to engage the top of the spark plug. The spark wire extends through the head cover and pipe. A vent hole is provided in the head cover.

14 Claims, 5 Drawing Figures

SPARK PLUG CAP APPARATUS

This invention relates to a spark plug cap apparatus which primarily is adapted for vehicle engines having vertical or near vertical openings of substantial depth in the top of the engine for the spark plugs, such as in overhead cam type engine.

One conventional apparatus of this kind is shown in U.S. Pat. No. 4,267,811 and consists of a spark plug cap including a plug pipe having a bush at the lower end and an expanding head cover of an elastic material, such as rubber, at the upper end. The plug cap is removably inserted into the spark plug bore which is formed in the engine head from the upper side such as to have a near vertical longitudinal shape and the opening at the upper end of the plug bore is closed by the head cover. It is preferable that the head cover of an apparatus of this type provide the opening at the upper end of the plug bore with a good seal for excluding moisture, water, oil and other foreign materials.

Accordingly it is an object of this invention to provide an improved apparatus of this type, which provides the spark plug bore opening at the upper end with a good seal.

A further and more detailed object of this invention is to provide an improved spark plug cap apparatus wherein the opening at the upper end of the spark plug bore is formed with an annular protrusion at its peripheral edge and the head cover is formed with a bent flange at the outer peripheral edge which engages with the annular protrusion, and further, an annular seal lip is provided on the head cover for inserting into the inner peripheral surface of the opening. A still further object is to provide such a spark plug cap apparatus with a ventilation opening that is effective without allowing foreign material into the bore.

Embodiments of the invention will be explained with reference to the accompanying drawings wherein.

Figure 3:
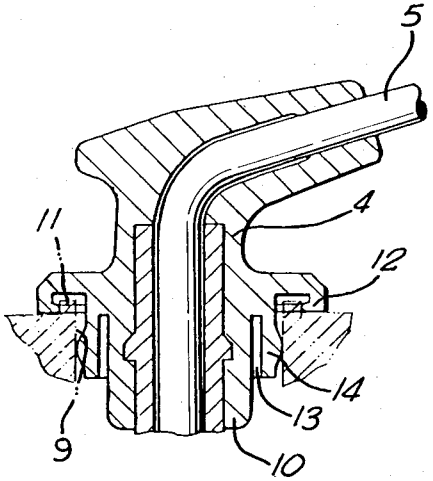
FIG. 3 is an enlarged sectional elevation of the head cover portion of the spark plug cap shown in FIGS. 1 and 2.
Figure 1:
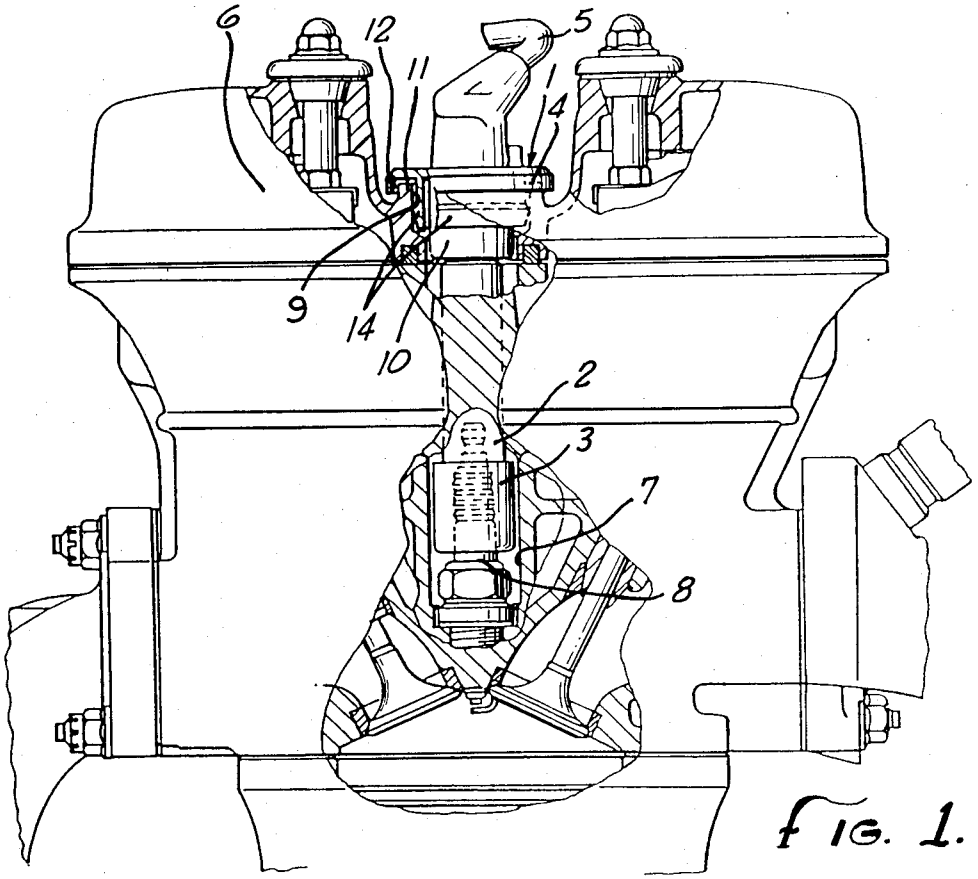
FIG. 1 is an elevation view of the cylinder head of an overhead valve engine with portions shown in cross-section to illustrate the location of the spark plug and the apparatus of this invention.
Figure 2:
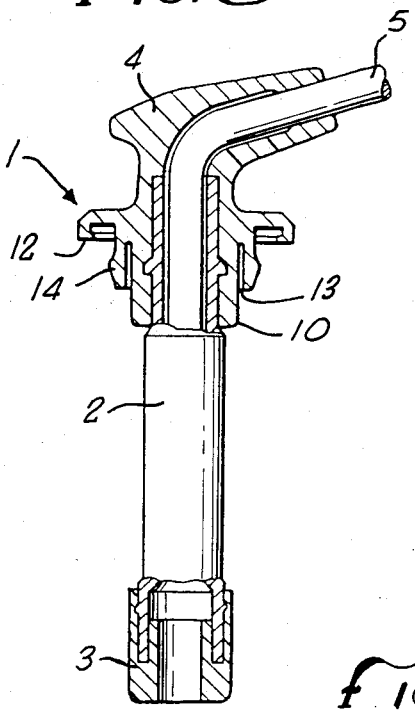
FIG. 2 is an enlarged sectional elevation of the spark plug cap of this invention shown in FIG. 1.

Referring now to the drawings, the spark plug cap, generally designated 1, includes a plug cap pipe 2 with a bush 3 at the lower end and an expanding head cover 4 of an elastic material, such as rubber, at the upper end. A spark plug wire 5 extends outwardly through the cover. The cap 1 is removably inserted into an elongated spark plug bore 7 which is formed in the cylinder head 6 of an engine such that its length is disposed in the vertical direction, with the bush 3 being placed over the spark plug 8 removably mounted at the bottom of the bore 7 and with the cover 4 closing the opening 9 at the upper end. The head cover 4 is placed over the top portion of the pipe 2 and they are bonded together at a boss 10 on the center of the lower surface of the cover 4.

The spark plug cap structure as thus far described is not strikingly different from a conventional one, but according to the present invention the opening 9 at the upper end is formed with an annular protrusion 11 at its peripheral edge, and the head cover 4 is formed with a bent flange 12 at the outer peripheral edge which engages the annular protrusion 11. Further an annular seal lip 14 is provided for inserting into the inner peripheral surface of the opening 9 and protrudes from the lower surface of the head cover 4 with a slight annular clearance 13 between the lip 14 and the outer peripheral surface of the boss 10.

The outer diameter of the bush 13 is preferably made comparatively large such as to prevent the plug cap 1 from oscillating when it is inserted into the plug bore 7 and to thereby assure the proper insertion and removal of the cap 1.

FIG. 3 illustrates the relationship formed between the head cover 4 and the opening 9 at the upper end when the cap 1 is inserted into the plug bore 7. The bent flange 12 of the cover 4 engages the outer peripheral surface of the annular protrusion 11 and the seal lip 14 tightly engages the inner peripheral surface of the opening 9. Since the lip 14 has the small clearance 13 between its inner surface and the central boss 10, a good sealing and inserting effect is obtained by slight inward compression of the lip 14 while maintaining elasticity.

As has been described above, according to the present invention, the bent flange of the outer peripheral edge of the head cover engages the outer peripheral surface of an annular protrusion from the upper end of the plug bore and a seal lip on the inner periphery of the cover engages the inner peripheral surface of the plug bore, whereby the head cover is securely located in the plug bore and provides a good double seal.

Figure 4:
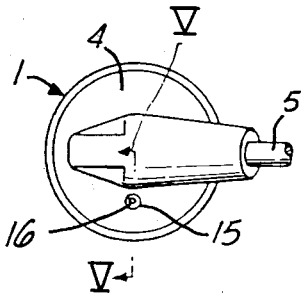
FIG. 4 is a plan view of a modified form of the spark plug cap shown in FIGS. 1, 2 and 3.
Figure 5:
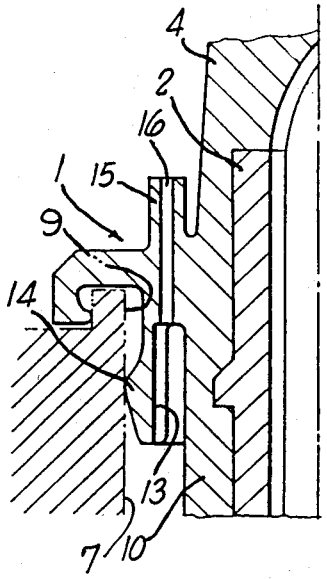
FIG. 5 is an enlarged sectional elevation view taken substantially on the line V—V in FIG. 4.

A modification of this invention is shown in FIGS. 4 and 5 to provide ventilation of the sapce within the spark plug bore 7. A cylindrical protrusion 15 extends upwardly from the top surface of head cover 4 and a hole 16 extends through protrusion 15 and cover 4. Hole 16 is prefeably of about 1 mm. diameter and opens into the annular space 13 at its lower end. Since the hole 16 is located above seal lip 14, the inward compression of seal lip 14 to accomplish the seal with bore 7 does not tend to close hole 16. Thus, the cap 1 may be installed without the captured air resisting the insertion of seal lip 14 and removed with the vacuum resistance that might otherwise occur without vent hole 16. The location of the open end of hole 16 on top of protrusion 15 inhibits the entry of any foreign fluid or material.

The invention claimed is:

1. A spark plug cap apparatus for an engine having an elongated and generally vertical spark plug bore having an upper open end, comprising, an upwardly extending annular protrusion on said upper open end of the bore, a cover means including a flange with means for extending over and sealably engaging an outer surface of said annular protrusion, and said cover means having a downwardly extending seal lip for sealably engaing an inner surface of the bore.

2. The spark plug cap apparatus of claim 1 wherein said cover means includes an opening therethrough for receiving a wire for connecting to a spark plug.

3. The spark plug cap apparatus of claim 1 wherein said seal lip is of a hollow cylindrical shape for allowing radial compression insertion into the bore, and said seal lip has an outer diameter slightly larger than the diameter of the bore.

4. A spark plug cap apparatus for an engine having an elongated and generally vertical spark plug receiving bore having an upper open end, comprising, an upwardly extending annular protrusion on said upper open end of the bore, a cover means including a member for extending over and sealably engaging an outer surface of said annular protrusion, and said cover means having a vent hole.

5. The spark plug cap apparatus of claim 4 wherein said cover means includes an opening therethrough for receiving a wire for connecing to a spark plug.

6. The spark plug cap apparatus of claim 4 wherein said cover means includes a downwardly extending seal lip for sealably engaging an inner surface of the bore.

7. The spark plug cap apparatus of claim 6 wherein said seal lip is of a hollow cylindrical shape for allowing radial inward compression upon insertion into the bore, and said seal lip has an outer diameter slightly larger than the diameter of the bore.

8. The spark plug cap apparatus of claim 4 wherein said cover means is provided with an upwardly extending protrusion and said vent hole extends upwardly through said protrusion.

9. A spark plug cap apparatus for an engine having an elongated and generally vertical spark plug receiving bore having an upper open end, comprising, an upwardly extending annular protrusion on said upper open end of the bore, a cover means including a member for extending over and sealably engaging an outer surface of said annular protrusion, and said cover means having a hollow cylindrical seal lip extending downwardly for sealably engaging the bore and an upwardly extending protrusion with a vent hole therethrough, said vent hole having a lower end located inwardly of said seal lip.

10. The spark plug cap apparatus of claim 9 wherein said cover means is of an elastic material, said member is elastically stretched over said annular protrusion, and said seal lip is elastically compressed inwardly in the bore.

11. A spark plug cap apparatus for an engine having an elongated and generally vertical spark plug receiving bore having an upper open end, comprising, an upwardly extending annular protrusion on said upper end of the bore, a cover means including a member for extending over and sealably engaging an outer surface of said annular protrusion, and a pipe means extending downwardly from said cover means for engaing a spark plug mounted in the bore.

12. The spark plug cap apparatus of claim 11 wherein the lower end of said pipe means is enlarged for closely fitting within the bore.

13. A spark plug cap apparatus for an engine having an elongated and generally vertical spark plug receiving bore having an upper open end, comprising, an upwardly extending annular protrusion on said upper end of the bore, a cover means including a member for extending over and sealably engaging an outer surface of said annular protrusion, a pipe means extending downwardly from said cover means for engaging a spark plug mounted in the bore, and a wire means passing through said pipe means to the spark plug.

14. In a spark plug cap apparatus for an engine having a spark plug receiving bore with an outwardly extending annular protrusion with an outer surface at an upper end of the bore, a head cover including, an outwardly extending member for extending over and sealably engaging the outer surface of the annular protrusion, a downwardly extending seal lip for sealably engaging an inner surface of the bore, and a vent hole through the head cover.

* * * * *